US005164157A

United States Patent [19]

Clark et al.

[11] Patent Number: 5,164,157

[45] Date of Patent: Nov. 17, 1992

[54] COPPER BASED ALLOY

[75] Inventors: Charles A. Clark, Chalfont St Giles; Prodyot Guha, High Wycombe, both of United Kingdom

[73] Assignee: Langley Alloys Limited, Slough, United Kingdom

[21] Appl. No.: 752,447

[22] PCT Filed: Mar. 16, 1990

[86] PCT No.: PCT/GB90/00396

§ 371 Date: Sep. 5, 1991

§ 102(e) Date: Sep. 5, 1991

[87] PCT Pub. No.: WO90/11381

PCT Pub. Date: Oct. 4, 1990

[30] Foreign Application Priority Data

Mar. 17, 1989 [GB] United Kingdom ..... 8906237

[51] Int. Cl.[5] ..... C22C 9/06

[52] U.S. Cl. ..... 420/486; 148/414; 148/435

[58] Field of Search ..... 420/486; 148/414, 435

[56] References Cited

FOREIGN PATENT DOCUMENTS 456018 3/1975 U.S.S.R. ..... 420/486
999438 7/1965 United Kingdom .
1161615 8/1969 United Kingdom ..... 420/486

*Primary Examiner*—R. Dean
*Assistant Examiner*—Margery S. Phipps
*Attorney, Agent, or Firm*—Dennison, Meserole, Pollack & Scheiner

[57] ABSTRACT

A copper based alloy, which when employed in a marine environment with a cathodic protection system or when galvanically coupled to a dissimilar metal, is resistant to hydrogen embrittlement, copper being present in an amount of about 70% to 80% by weight, and the alloy having in addition, (by weight):

| | | | |
|---|---|---|---|
| nickel | 13.5% | to | 20.0% |
| aluminium | 1.4% | to | 2.0% |
| manganese | 3.4% | to | 9.3% |
| iron | 0.5% | to | 1.5% |
| chromium | 0.3% | to | 1.0% |
| niobium | 0.5% | to | 1.0% |

and wherein the constituent elements are so controlled that:

A Cu/(Mn+Ni) is less than 4.9 in terms of weight %;

B Cu/(Mn+Ni) is greater than 3 in terms of weight %;

C Al+Nb is at least 2.1 in terms of weight %; and

D Ni/(Al+Nb) is at least 6.0 in terms of weight %.

5 Claims, 1 Drawing Sheet

COPPER BASED ALLOY

Figure 1:
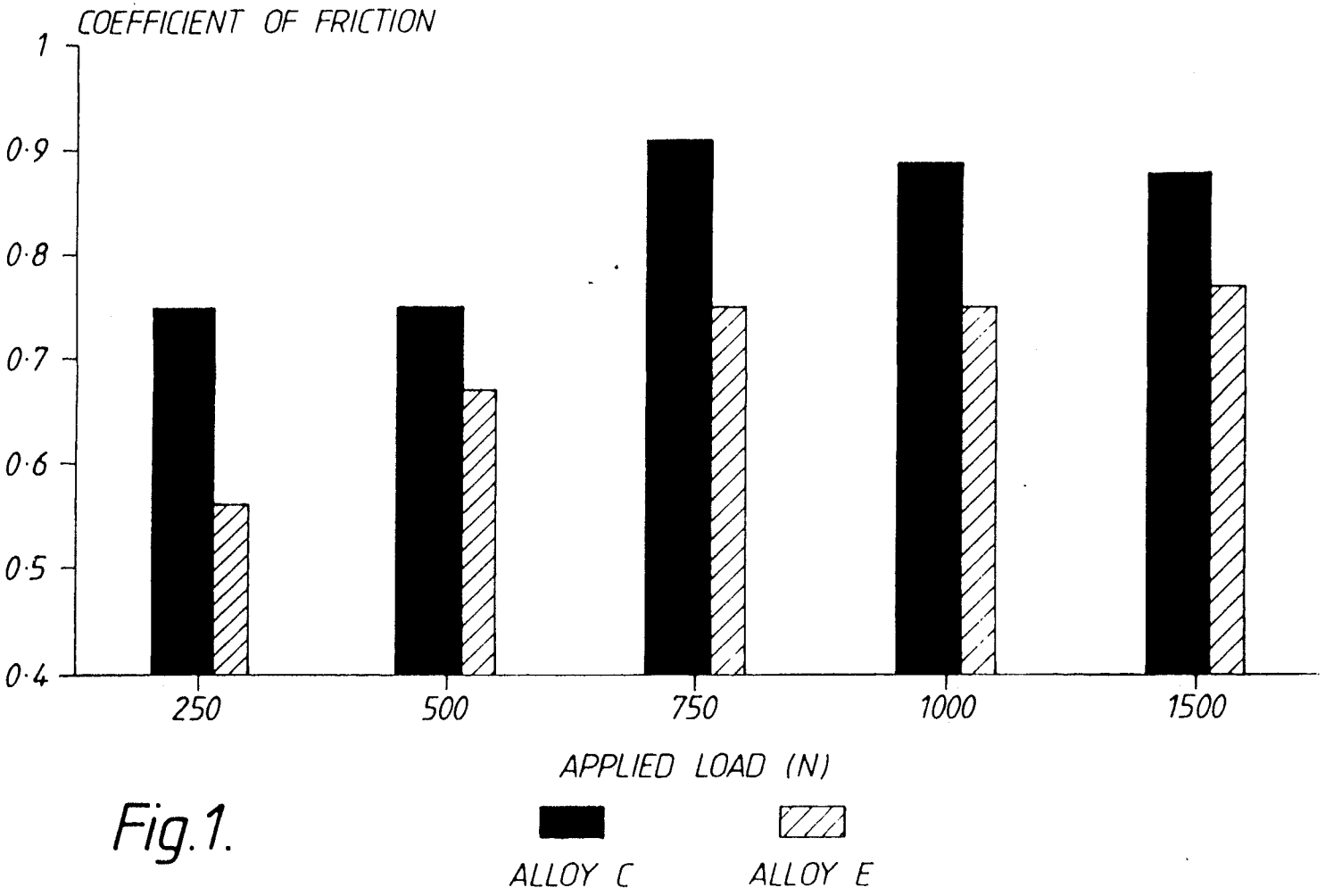

This invention relates to copper based alloys, the copper being present in an amount of about 70% to 80% by weight.

Copper-nickel-manganese alloys have been known for many years, and such alloys have found many uses not least in marine environments. In the particular application of alloys for fasteners and shafts, in a marine environment, high strength combined with good ductility is required preferably with minimum properties as indicated below:

| | |
|---|---|
| Cross sectional thickness of fastener- | up to 75 mm |
| After suitable hot working, followed by heat treatment: | |
| Minimum 0.2% proof stress | 700 N/mm$^2$ |
| Minimum tensile strength | 870 N/mm$^2$ |
| Minimum elongation. | 12% |
| Cross sectional thickness of fastener- | over 75 mm |
| After suitable hot working. followed by heat treatment: | |
| Minimum 0.2% proof stress | 650 N/mm$^2$ |
| Minimum tensile strength | 840 N/mm$^2$ |
| Minimum elongation. | 15% |

This level of strength and ductility can be achieved by high strength duplex stainless steels and other alloys by cold working, and also by certain low alloy carbon steels, and by certain nickel-based alloys, but not by the general run of copper based alloys. (An exception is beryllium-copper alloy but this is not generally acceptable because of the toxicity of beryllium and high cost.)

Moreover, high strength and ductility are not the only necessary requirements of an alloy which is intended to be used to fabricate fasteners for use in marine environments. In such environments, cathodic protection systems are employed in which an electric current is generated between a sacrificial anode such as zinc and the remainder of the structure. Under these conditions the sacrificial anode corrodes in preference to the other material and hydrogen is generated in atomic form by electrolysis of the seawater.

Galvanic coupling between dissimilar metals can also lead to corrosion currents, the generation of hydrogen due to electrolysis of seawater, and absorption of hydrogen and resultant embrittlement of the more noble cathodic metal.

It has been found that premature failures of fastenings, in particular bolts, have occured due to embrittlement resulting from the passage of this hydrogen into the high strength steels and nickel-base alloys from which the bolts are manufactured.

Hydrogen embrittlement adversely affects most bolting materials, including high carbon steels, nickel base alloys, titanium alloys, and duplex steels.

Therefore there exists a need for an alloy which in a marine, offshore environment is essentially immune to hydrogen embrittlement and which is capable of being processed and heat treated to give levels of strenght and ductility which equate with those indicated above. These levels of strength and ductility must also be retained after prolonged exposure to hydrogen for say 1500 hours in seawater.

The alloy should also be resistant to corrosion in seawater and should also preferably be resistant to galling, a phenomenon in which surfaces tend to adhere together when in sliding contact as for example during the tightening of a nut on a bolt. This last requirement is met if the alloy has a relatively low coefficient of friction even when under high load.

The present invention is based upon the belief that a useful copper based alloy will result if when the alloy is melted, cast and heat treated, a hardening precipitate is formed which is of the type $Ni_3Al$, but which in all probability will be $(Ni,Mn)_3(Al,Nb)$ so that some of the nickel and aluminium atoms in the crystal lattice of the precipitate are substituted by manganese and niobium atoms respectively. A further benefit arises if some of the strengthening of the alloy is achieved by precipitation of chromium in that a higher ductility can be achieved at a given strength level.

The alloy is intended, in particular, for the production of fasteners, and it will be recalled that the alloy should respond to appropriate hot working and subsequent heat treatment to acquire and exhibit the following mechanical properties

| | |
|---|---|
| Cross sectional thickness of fastener- | up to 75 mm |
| Minimum 0.2% proof stress | 700 N/mm$^2$ |
| Minimum tensile strength | 870 N/mm$^2$ |
| Minimum elongation, | 12% |

It is also preferably if these properties can be achieved by heat treatment alone, rather than by use of cold working, since in the latter case, it would not be possible to use subsequent hot forming operations to produce fasteners, because this later process would nullify the beneficial effect of the earlier cold working.

According to the present invention, these criteria of strength and ductility coupled with good anti-galling characteristics, together with resistance to hydrogen embrittlement and corrosion when in a marine environment, can be achieved with an alloy in which copper is present in an amount of about 70% to 80% by weight and the alloy having in addition, by weight:

| | | | |
|---|---|---|---|
| nickel | 13.5% | to | 20.0% |
| aluminium | 1.4% | to | 2.0% |
| manganese | 3.4% | to | 9.3% |
| iron | 0.5% | to | 1.5% |
| chromium | 0.3% | to | 1.0% |
| niobium | 0.5% | to | 1.0% |

and the aforementioned criteria of strength and ductility, coupled with a resistance to corrosion and to embrittlement when in a hydrogen environment, may be achieved if its constituents are controlled in the following manner, which is one essential characteristic of this invention (another being appropriate hot working and subsequent heat treatment, if best results are to be achieved):

(A) If Cu/(Mn+Ni) is greater than 4.5, [expressed as an atomic percentage (At %) i.e. the percentage of the number of atoms of the respective elements in the alloy] not enough Ni and Mn is present to combine with the Al and Nb, and lower ductility and strength combination results.

Accordingly, in weight % terms, Cu/(Mn+Ni) must be less than 4.9.

(B) If Cu/(Mn+Ni) is less than 2.8, (At %), the alloy is necessarily expensive, and as nickel and manganese increase, the material shows increasing propensity to galling and hydrogen embrittlement. Also, with higher nickel contents, the alloy is more difficult to forge.

Accordingly, in weight % terms, Cu/Mn+Ni must be greater than 3.

(C) If Al+Nb is less than 3.9 (At %), the strength of the alloy is inadequate for manufacture of high strength fasteners and shafts.

Accordingly, in weight terms, Al+Nb should be at least 2.1.

(D) If Ni/(Al+Nb) is less than 3.4 (At %), poor resistance to corrosion in a marine environment and lower ductility result.

Accordingly, in weight % terms, Ni/(Al+Nb) must be at least 6.0.

Chromium improves forgeability, and inhibits grain growth which facilitates ultrasonic inspection to check for internal defects. However, if the chromium content is greater than 1% by weight, or 1.1% atomic, ductility declines. Chromium in small amounts also contributes to strength and accordingly needs to be present in an amount of at least 0.3% by weight.

If niobium is present in an amount of less than 0.3 atomic %, or 0.5 by weight %, the alloy exhibits a loss of ductility when it is otherwise strong enough for employment in the manufacture of fasteners such as nuts and bolts, all for use in a marine environment.

Optionally such an alloy may contain traces of other elements. For example it may have one or more of up to 0.05% sulphur; up to 0.2% silicon; up to 0.05% zinc; up to 0.01% phosphorus; up to 0.05% tin; up to 0.02% carbon; up to 0.04% magnesium; and up to 0.02% lead (all by weight).

Preferably the alloy is produced by melting and casting into ingots which are then forged and/or hot rolled into bars whether round or of other cross-section. Hot working is carried out in the temperature range 960° C. to 1010° C. Such hot working is preferably such that, comparing the alloy in its form as a finished product with its form when just having been melted and cast as an ingot, its cross-sectional area is reduced by about 90%. Following such extensive hot working, the alloy benefits from ageing at 450° C. to 600° C. for from 1.5 to 4 hours and preferably at least 2 hours.

Such extensive hot working, that is, such as to achieve a reduction of 90% in cross-sectional area, is not always practical in the case of products whose final cross-sectional thickness exceeds 75 mm. In this case, after hot working and heat treatment, the following mechanical properties should be achievable:

| Cross sectional thickness of product- | over 75 mm |
|---|---|
| Minimum 0.2% proof stress | 650 N/mm$^2$ |
| Minimum tensile strength | 840 N/mm$^2$ |
| Minimum elongation, | 15% |

The alloy can be hot rolled to produce round and hexagonal bars, forged into shafts and flanges, hot upset and thread rolled to produce fasteners. The alloy may also be hot extruded and cold drawn to produce tubular products. A final ageing at 450° to 600° C. increases strength to target requirements.

When the alloy is induction heated, e.g. when making headed bolts by upset forging, it is less susceptible to cracking from thermal shock, a susceptibility experienced with some other high strength cupro-nickels Solution heat treatment confers no benefit to the alloys as forged.

The control of grain growth effected by the additions of chromium and niobium is significant in ensuring that the alloy will meet the requirements of ultrasonic inspection and testing, usually mandatory when alloys are to be employed in many offshore marine environments, military applications and critical chemical plant.

However most importantly, it is a corrosion resistant high strength alloy with exceptional resistance to hydrogen embrittlement and to galling.

The alloy according to the invention has good resistance to corrosion in marine environments, to fouling by marine organisms and has low magnetic permeability. The strength of the alloy is comparable with that of other bolting materials and the alloy has the additional advantage of good galling resistance. Used as a fastener it will be compatible with other cupro nickels and high alloy steels. It will be less costly than 70/30 nickel-copper and other high nickel alloys and also titanium-based products.

Table 1 gives the composition of certain alloys the mechanical properties of which are shown in Table 2 together with results of a test for embrittlement after exposure to cathodic protection in sodium chloride solution while under stress.

In Table 1:

Alloy A is a fastener grade low carbon steel, being a B7 alloy according to ASTM A193.

Alloy B is an example of duplex steel, FERRALIUM 255. (FERRALIUM is a Registered Trade Mark of Langley Alloys Ltd)

Alloy C is an example of MONEL Alloy K 500. (MONEL is a Registered Trade Mark of INTERNATIONAL NICKEL Co Ltd)

Alloy D is an example of HIDURON 191 alloy. (HIDURON is a Registered Trade Mark of Langley Alloys Ltd)

Alloy E is an alloy according to the present invention, and is the same alloy as Example 7, further particulars of which are given in Tables 3 and 4.

Table 2 indicates that alloys A to C have high levels of strength and ductility. However when these alloys are exposed in circumstances where atomic hydrogen is released in seawater, they suffer marked embrittlement as indicated by the reduction in ductility. Alloy D does not suffer significant embrittlement when exposed, but on the other hand this copper based alloy has inadequate strength. Much better strength is exhibited in Alloy E and it too suffers only insignificant loss of ductility when exposed to hydrogen.

This invention relates to copper based alloys, the copper being present in an amount of about 70% to 80% by weight and the alloy having in addition, by weight:

| | | | |
|---|---|---|---|
| nickel | 13.5% | to | 20.0% |
| aluminium | 1.4% | to | 2.0% |
| manganese | 3.4% | to | 9.3% |
| iron | 0.5% | to | 1.5% |
| chromium | 0.3% | to | 1.0% |
| niobium | 0.5% | to | 1.0% |

And such an alloy may contain traces of other elements. For example it may have one or more of up to 0.05% sulphur; up to 0.2% silicon; up to 0.05% zinc; up to 0.01% phosphorus; up to 0.05% tin; up to 0.02% carbon; up to 0.04% magnesium; and up to 0.02% lead (all by weight).

Alloys of this general type, that is copper-nickel-manganese alloys, often with additions of iron, chromium and niobium, have been known for many years. Such alloys have found many uses not least in marine environments. Alloy D of Table 1 is one example of such a known alloy; Examples 1 to 5 of Table 3 are other examples. However these copper based alloys, while they may be resistant to embrittlement due to absorption of atomic hydrogen, have only moderate mechanical strength. As such, they are usually considered unsuitable for production in the form of high strength fasteners, such as nuts and bolts, or in the form of shafts which, in use in the marine environment, are intended to be highly stressed.

Here, in addition to resistance to corrosion, high mechanical strength combined with ductility is required, preferably with minimum properties as specified below:

| | |
|---|---|
| Cross sectional thickness of fastener- | up to 75 mm |
| After suitable hot working, followed by heat treatment: | |
| Minimum 0.2% proof stress | 700 N/mm$^2$ |
| Minimum tensile strength | 870 N/mm$^2$ |
| Minimum elongation. | 12% |

In the case of products of larger cross section these specified properties are slightly lower as indicated below:

| | |
|---|---|
| Cross sectional thickness of fastener | over 75 mm |
| After suitable hot working, followed by heat treatment: | |
| Minimum 0.2% proof stress | 650 N/mm$^2$ |
| Minimum tensile strength | 840 N/mm$^2$ |
| Minimum elongation. | 15% |

In Table 3, Examples 6, 7 and 8 are alloys according to this invention. The above specified criteria of strength and ductility, together with resistance to hydrogen embrittelment and good anti-galling characteristics, have been achieved in these Examples, by controlling the constituent elements of each alloy in the following manner:

(A) In weight % terms, Cu/(Mn+Ni) is less than 4.9.

(B) In weight % terms, Cu/Mn+Ni is greater than 3.

(C) In weight % terms, Al+Nb is at least 2.1.

(D) In weight % terms, Ni/(Al+Nb) is at least 6.0.

In contrast, the alloy of Example 1 has no niobium and very little chromium; and as a result it has low strength. In the alloy of Example 2, the niobium content is high and the aluminium content is low; this also gives inadequate strength. In Example 3, the aluminium content and the niobium content are below the ranges specified for this invention; and again, low strength results. In Example 4, the niobium is below the range specified, while in Example 5 both the aluminium and niobium contents are below the range now specified; and again, low strength results.

All the alloy Examples of Table 3 were produced in a similar fashion. The alloys were first melted and then cast into ingots of about 250 mm in diameter. Then, at a temperature of between 960° C. and 1010° C., they were subjected to successive forging operations; first to give bars of 150 mm diameter; then to give bars of 75 mm diameter. Alloy Examples 1 to 8 were then further hot worked and formed into round bars having the diameters given in the Table. In the case of Examples 1 to 8, the hot working was extensive and the cross-sectional area of the final product represented a reduction of at least 90% as compared with the cross-sectional area of the cast ingot. All of the alloys of Examples 1 to 8 were finally heat treated for two hours at a temperature of 500° C., and subsequently cooled in air.

Further tests were carried out on alloy Examples 7 and 8, which are alloys according to the invention. These tests are shown in Table 4. Bars having diameters of 75 mm and 32 mm were tested. The significance of differing final heat treatment temperatures will be noted from this Table.

Table 5 shows the results of tests of the alloy according to this invention both when unexposed and when exposed to atomic hydrogen in seawater; and these tests are of the alloy both when free of stress with no hydrogen present and when exposed to hydrogen under sustained load. When the alloy was subjected to stress at 110% of its proof stress, it was subjected to plastic deformation; and it was in effect being subjected to cold working when sustaining such stress. These tests show that the alloy according to the invention suffers minimal loss of ductility as a result of this exposure under sustained stress.

Table 6 shows the result of a test measuring cavitation in seawater. An alloy according to this invention, exhibited a low rate of erosion in this test. The good cavitation erosion resistance is an important requirement for tubes carrying high velocity sea water or other liquids.

FIG. 1 is a graph exhibiting a comparison between Alloy C of Table 1 and Alloy E according to this invention. The measurement here is of the coefficient of friction under increasing load. The alloy according to the invention exhibits relatively lower frictional resistance when loaded. Such an alloy will be resistant to galling, this being the phenomenon of binding which is liable to occur when for example a nut is tightened on a threaded bolt under load.

TABLE 1

| | Alloy Compositions | | | | |
|---|---|---|---|---|---|
| | A | B | C | D | E |
| Al | — | — | 3.06 | 1.48 | 1.79 |
| C | 0.38 | 0.04 | 0.182 | 0.015 | 0.01 |
| Cr | 1.1 | 25.3 | — | 0.07 | 0.36 |
| Cu | — | 1.96 | Bal | Bal | Bal |
| Fe | Bal | Bal | 0.34 | 0.9 | 0.99 |
| Mn | 1.0 | 1.04 | 0.37 | 4.24 | 4.4 |
| Mo | 0.3 | 2.63 | — | — | — |
| N | — | 0.18 | — | — | — |
| Nb | — | — | — | — | 0.72 |
| Ni | — | 5.5 | 67 | 14.4 | 15.8 |
| Ti | — | — | 0.65 | — | — |

Bal = Balance, including insignificant impurities and traces of other elements.

TABLE 2

Slow Strain Rate Test Results
Specimen exposed in 3.5% NaCl with imposed potential of −1.0 V (Saturated Calomel Electrode) and then tested at strain rate of 5 × 10$^{-6}$/S.
A potential of −1 V was maintained during test.

| | Tensile Strength N/mm$^2$ | % Elongation | % Reduction of area |
|---|---|---|---|
| ALLOY A | | | |
| Before exposure | 1078 | 19 | 62 |
| After exposure (63 hrs) | 1050 | 17 | 40 |
| ALLOY B | | | |
| Before exposure | 885 | 40 | 72 |
| After exposure (400 hrs) | 848 | 19 | 22 |
| ALLOY C | | | |
| Before exposure | 1015 | 24 | 37 |
| After exposure (915 hrs) | 986 | 15 | 17 |

TABLE 2-continued

| Slow Strain Rate Test Results Specimen exposed in 3.5% NaCl with imposed potential of −1.0 V (Saturated Calomel Electrode) and then tested at strain rate of 5 × $10^{-6}$/S. A potential of −1 V was maintained during test. | Tensile Strength N/mm² | % Elongation | % Reduction of area |
|---|---|---|---|
| ALLOY D | | | |
| Before exposure | 800 | 24 | 59 |
| After exposure (2000 hrs) | 812 | 22 | 61 |
| ALLOY E | | | |
| Before exposure | 942 | 16.1 | 30 |
| After exposure (1500 hrs) | 943 | 15 | 28 |

TABLE 5-continued

| Specimen Alloys according to invention Before and After Exposure to Hydrogen for 70 days in seawater | | | | |
|---|---|---|---|---|
| Alloy | 0.2% Proof Stress | Tensile Strength (N/mm²) | Elongation % (N/mm²) | Reduction in Area % |
| a | 828 | 1004 | 13 | 31.4 |
| b | 844 | 1017 | 14 | 32.7 |
| c | 870 | 1000 | 10 | 21.5 |
| Test 3 - Exposed to hydrogen and sustained for 70 days under 110% load; then tensile tested in air | | | | |
| a | 948 | 1028 | 11 | 32.8 |
| b | 961 | 1035 | 13 | 34.9 |
| c | 854 | 1039 | 12 | 32.9 |

Load is expressed as a percentage of the proof stress.
Bars of the same alloy composition and having the same dimension were tested in each case.

TABLE 3

| Alloy Code No | AFTER NOT WORKING AT 960° C. to 1010° C. Ex. No | BAR SIZE mm | HEAT TREATMENT AC = Air cooled | MECHANICAL PROPERTIES 0.2% Proof Stress 0.2% N/mm | Tensile Strength N/mm² | Elongation % | COMPOSITION BY WEIGHT - Balance Copper Ni % | Al % | Mn % | Fe % | Cr % | Nb % |
|---|---|---|---|---|---|---|---|---|---|---|---|---|
| E6369 | 1 | 37 | 500° C. 2 hrs AC | 561 | 790 | 20 | 13.9 | 1.42 | 4.24 | 0.8 | 0.15 | Nil |
| X5671 | 2 | 32 | 500° C. 2 hrs AC | 589 | 796 | 16.1 | 15.8 | 0.93 | 4.42 | 1.04 | 0.40 | 1.64 |
| E5592 | 3 | 32 | 500° C. 2 hrs AC | 520 | 780 | 21.0 | 13.8 | 1.25 | 4.27 | 0.74 | 0.09 | 0.01 |
| E6177 | 4 | 75 | 500° C. 2 hrs AC | 632 | 837 | 18.6 | 14.7 | 1.40 | 4.16 | 0.94 | 0.37 | 0.48 |
| X4881 | 5 | 75 | 500° C. 2 hrs AC | 550 | 759 | 21.4 | 15.7 | 0.85 | 4.33 | 0.99 | 0.35 | 0.21 |
| E6819B | 6 | 24 | 500° C. 2 hrs AC | 756 | 998 | 14.0 | 15.2 | 1.58 | 4.45 | 0.97 | 0.38 | 0.91 |
| X5672 | 7 | 32 | 500° C. 2 hrs AC | 770 | 965 | 14.3 | 15.8 | 1.79 | 4.40 | 0.99 | 0.36 | 0.72 |
| X5673 | 8 | 32 | 500° C. 2 hrs AC | 740 | 936 | 14.3 | 15.8 | 1.59 | 4.38 | 0.98 | 0.36 | 0.72 |

TABLE 4

| Alloy Code No | AFTER NOT WORKING AT 960° C. to 1010° C. Ex. No | BAR SIZE mm | HEAT TREATMENT AC = Air cooled | MECHANICAL PROPERTIES 0.2% Proof Stress 0.2% N/mm | Tensile Strength N/mm² | Elongation % | Izod J | COMPOSITION BY WEIGHT - Balance Copper Ni % | Al % | Mn % | Fe % | Cr % | Nb % |
|---|---|---|---|---|---|---|---|---|---|---|---|---|---|
| X5672 | 7 | 75 | As-forged | 669 | 880 | 17.1 | 36,36,38 | 15.8 | 1.79 | 4.40 | 0.99 | 0.36 | 0.72 |
| | | | 450° C. 2 hrs AC | 714 | 917 | 14.3 | 27,28,28 | | | | | | |
| | | | 500° C. 2 hrs AC | 728 | 926 | 14.3 | 26,26,27 | | | | | | |
| | | | 550° C. 2 hrs AC | 697 | 894 | 16.4 | 30,30,31 | | | | | | |
| | | | 600° C. 2 hrs AC | 654 | 861 | 17.5 | 35,35,36 | | | | | | |
| | 7 | 32 | As-rolled | 694 | 908 | 17.1 | 38,39,40 | | | | | | |
| | | | 450° C. 2 hrs AC | 744 | 953 | 15.7 | 24,25,25 | | | | | | |
| | | | 500° C. 2 hrs AC | 770 | 965 | 14.3 | 21,22,23 | | | | | | |
| | | | 550° C. 2 hrs AC | 739 | 942 | 16.1 | 25,25,25 | | | | | | |
| | | | 600° C. 2 hrs AC | 703 | 917 | 15.7 | 27,27,27 | | | | | | |
| X5673 | 8 | 75 | As-forged | 697 | 868 | 16.0 | 22,26,26 | 15.8 | 1.59 | 4.38 | 0.98 | 0.36 | 0.72 |
| | | | 450° C. 2 hrs AC | 757 | 906 | 12.5 | 21,22,23 | | | | | | |
| | | | 500° C. 2 hrs AC | 764 | 917 | 10.7 | 17,18,19 | | | | | | |
| | | | 550° C. 2 hrs AC | 720 | 889 | 12.1 | 18,20,24 | | | | | | |
| | | | 600° C. 2 hrs AC | 678 | 852 | 13.2 | 24,25,27 | | | | | | |
| | 8 | 32 | As-rolled | 661 | 871 | 16.8 | 41,42,42 | | | | | | |
| | | | 450° C. 2 hrs AC | 720 | 925 | 16.1 | 27,28,28 | | | | | | |
| | | | 500° C. 2 hrs AC | 740 | 936 | 14.3 | 23,23,24 | | | | | | |
| | | | 550° C. 2 hrs AC | 717 | 923 | 16.1 | 26,26,27 | | | | | | |
| | | | 600° C. 2 hrs AC | 669 | 892 | 17.1 | 26,27,26 | | | | | | |

TABLE 5

| Specimen Alloys according to invention Before and After Exposure to Hydrogen for 70 days in seawater | | | | |
|---|---|---|---|---|
| Alloy | 0.2% Proof Stress | Tensile Strength (N/mm²) | Elongation % (N/mm²) | Reduction in Area % |
| Test 1 - not exposed to hydrogen and no load sustained; tensile tested in air | | | | |
| a | 854 | 997 | 12 | 20.4 |
| b | 841 | 1014 | 15 | 33.2 |
| c | 826 | 1005 | 14 | 33.2 |
| Test 2 - Exposed to hydrogen and sustained for 70 days under 75% load; then tensile tested in air | | | | |

TABLE 6

| Test for Cavitation in Seawater | |
|---|---|
| Alloy | Erosion Rate mm³/hr |
| Alloy D (wrought) | 1.8 |
| Alloy D (cast) | 2.3 |
| 70/30 cupronickel (wrought) | 1.9 |
| Alloy E (wrought) | 1.0 |

What is claimed is:

1. A copper based alloy, which when employed in a marine environment with a cathodic protection system or when galvanically coupled to a dissimilar metal, is resistant to hydrogen embrittlement, copper being present in an amount of about 70% to 80% by weight, and the alloy having in addition, by weight:

| | | | |
|---|---|---|---|
| nickel | 13.5% | to | 20.0% |
| aluminium | 1.4% | to | 2.0% |
| manganese | 3.4% | to | 9.3% |
| iron | 0.5% | to | 1.5% |
| chromium | 0.3% | to | 1.0% |
| niobium | 0.5% | to | 1.0% |

and wherein the constituent elements are so controlled that:

(A) Cu/(Mn+Ni) is less than 4.9 in terms of weight %;

(B) Cu/(Mn+Ni) is greater than 3 in terms of weight %;

(C) Al+Nb is at least 2.1 in terms of weight %; and (D) Ni/(Al+Nb) is at least 6.0 in terms of weight %.

2. A copper based alloy according to claim 1, and including in addition one or more of the elements, by weight: up to 0.05% sulphur; up to 0.2% silicon; up to 0.05% zinc; up to 0.01% phosphorus; up to 0.05% tin; up to 0.02% carbon; up to 0.04% magnesium; and up to 0.02% lead.

3. An alloy according to either of claims 1 or 2, which is treated by melting and casting and then subjecting to hot working in the temperature range 960° C. to 1010° C., followed by heat treating for from at least 1.5 to 4 hours at a temperature in the range 450° C. to 600° C., and which exhibits the mechanical properties, in the form of a finished product having a cross-sectional dimension not exceeding 75 mm:

| | |
|---|---|
| Minimum 0.2% proof stress | 700 N/mm$^2$ |
| Minimum tensile strength | 870 N/mm$^2$ |
| Minimum elongation | 12% |

4. An alloy according to claim 3, wherein the hot working has been sufficiently extensive that a reduction in cross-sectional area of at least 90% is achieved as compared to the alloy when in cast form immediately after initial melting.

5. A copper-based alloy resistant to hydrogen embrittlement, consisting essentially of, by weight:

| | |
|---|---|
| copper | 70–80% |
| nickel | 13.5–20% |
| aluminum | 1.4–2.0% |
| manganese | 3.4–9.3% |
| iron | 0.5–1.5% |
| chromium | 0.3–1.0% |
| niobium | 0.5–1.0% |
| sulphur | up to 0.05% |
| silicon | up to 0.2% |
| zinc | up to 0.05% |
| phosphorus | up to 0.01% |
| tin | up to 0.05% |
| carbon | up to 0.02% |
| magnesium | up to 0.04% |
| lead | up to 0.02% |

wherein:

% Cu/(% Mn+% Ni) is greater than 3 and less than 4.9;

% Al+Nb is at least 2.1; and

% Ni/(% Al+% Nb) is at least 6.0.

* * * * *